US009273659B2

(12) United States Patent
Evans et al.

(10) Patent No.: US 9,273,659 B2
(45) Date of Patent: Mar. 1, 2016

(54) STARTING DEVICE FOR AN INTERNAL COMBUSTION ENGINE

(75) Inventors: Jonathan Evans, Charlotte, NC (US); Thomas G. Glore, Texarkana, AR (US)

(73) Assignee: HUSQVARNA AB, Huskvarna (SE)

( * ) Notice: Subject to any disclaimer, the term of this patent is extended or adjusted under 35 U.S.C. 154(b) by 65 days.

(21) Appl. No.: 13/810,178

(22) PCT Filed: Nov. 17, 2010

(86) PCT No.: PCT/US2010/056979

§ 371 (c)(1), (2), (4) Date: Jan. 14, 2013

(87) PCT Pub. No.: WO2012/008980

PCT Pub. Date: Jan. 19, 2012

(65) Prior Publication Data

US 2013/0104834 A1 May 2, 2013

Related U.S. Application Data

(60) Provisional application No. 61/364,371, filed on Jul. 14, 2010.

(51) Int. Cl.
*F02N 3/02* (2006.01)
*F02N 5/02* (2006.01)

(52) U.S. Cl.
CPC .... *F02N 3/02* (2013.01); *F02N 5/02* (2013.01)

(58) Field of Classification Search
CPC ..... F02N 3/02; F02N 5/02; F02N 15/00; F02B 63/02; F02B 2075/025
USPC ..... 123/185.3; 57/256
See application file for complete search history.

(56) References Cited

U.S. PATENT DOCUMENTS 3,016,683 A * 1/1962 Simpson ..... 57/256
4,962,617 A * 10/1990 Tilders et al. ..... 451/359

(Continued)

FOREIGN PATENT DOCUMENTS

| | | | |
|---|---|---|---|
| EP | 1596060 | A2 | 11/2005 |
| EP | 1712779 | A2 | 10/2006 |
| GB | 905782 | A | 9/1962 |
| WO | 2012008980 | A1 | 1/2012 |

OTHER PUBLICATIONS

Notification of Transmittal of The International Search Report and The Written Opinion of the International Searching Authority, or The Declaration; for International Application No. PCT/US2010/056979; dated Mar. 29, 2011.

(Continued)

*Primary Examiner* — Stephen K Cronin
*Assistant Examiner* — Joshua A Campbell
(74) *Attorney, Agent, or Firm* — Nelson Mullins Riley & Scarborough LLP

(57) ABSTRACT

A rope-pull starting device for an internal combustion engine including a hub, rope pulley, rope and torsion damper spring. The hub configured to drivingly engage an engine when the hub is rotated in a first direction. The rope pulley interconnects with the hub by a torsion damper spring. The torsion damper spring coupled at a first end to the hub and at a second end to the rope pulley, wherein the torsion damper spring is coiled from the first end connected to the hub, toward the rope pulley, in a second direction opposite to the first direction, and whereby the rope pulley is rotated in the first direction when the rope is unwound therefrom and the torsion damper spring responsively urges the hub to rotate in the first direction.

20 Claims, 7 Drawing Sheets

(56) References Cited

U.S. PATENT DOCUMENTS

| | | | | |
|---|---|---|---|---|
| 5,029,561 | A * | 7/1991 | Koga | 123/185.3 |
| 7,191,752 | B2 * | 3/2007 | Schriever et al. | 123/185.3 |
| 7,963,266 | B2 * | 6/2011 | Kapinsky et al. | 123/185.3 |
| 8,132,553 | B2 * | 3/2012 | Eakins, Jr. | 123/185.3 |
| 8,291,879 | B2 * | 10/2012 | Eakins, Jr. | 123/185.3 |
| 2009/0255502 | A1 * | 10/2009 | Cook | 123/185.3 |
| 2010/0170465 | A1 | 7/2010 | Eakins, Jr. | |
| 2012/0199091 | A1 * | 8/2012 | Bohling | 123/185.3 |

OTHER PUBLICATIONS

International Search Report for International Application No. PCT/US2010/056979; dated Mar. 29, 2011.

Written Opinion of the International Searching Authority for International Application No. PCT/US2010/056979; dated Mar. 29, 2011.

* cited by examiner

STARTING DEVICE FOR AN INTERNAL COMBUSTION ENGINE

CROSS REFERENCE TO RELATED APPLICATIONS

This application is a national stage entry of PCT/US2010/56979, filed on Nov. 17, 2010, which claims priority from U.S. Provisional Pat. App. Ser. No. 61/364,371, filed on Jul. 14, 2010, the contents of each of said applications are incorporated herein in their entirety for all purposes.

FIELD

The present disclosure relates to a starting device for an internal combustion engine. Specifically, the present disclosure presents an arrangement for rotating a hub based upon rotation of a coil spring.

BACKGROUND

Internal combustion engines are often provided with a manual starting mechanism. For example, a chainsaw includes a rope starting mechanism for starting the internal combustion engine. The rope starter uses the force from the operator to rotate an associated pulley which in turn is coupled, through one or more components, to the crankshaft of the engine. The starter can include a rope pulley and hub for coupling with a clutch mechanism of the internal combustion engine. When starting an engine, the operator can experience forces from the engine as the rope is pulled. It is desirable to provide a starter with increased performance.

BRIEF DESCRIPTION OF THE DRAWINGS

Implementations of the present application will now be described, by way of example only, with reference to the attached figures, wherein.

DETAILED DESCRIPTION

Figure 1:
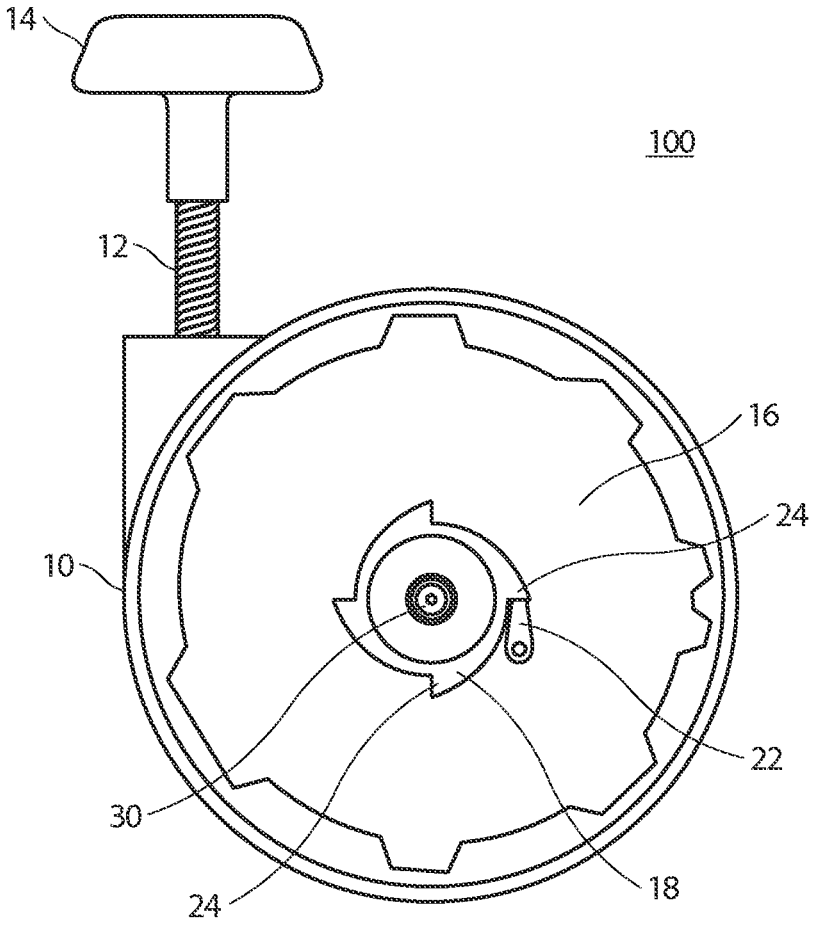
FIG. 1 illustrates an exemplary starting device according to the present disclosure in a simplified housing.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein.

FIG. 1 illustrates an exemplary starting device. The starting device 100 as illustrated can be a rope-pull starting device for an internal combustion engine (not shown). The starting device 100 can be for a hand-held power driven tool. Examples of hand-held power driven tools include, chainsaws, line trimmers, leaf blowers, snow blowers, and other tools having an internal combustion engine for driving a tool. Additionally, as illustrated in FIG. 1, the starter device 100 is for a chainsaw, but can be adapted for other hand-held power driven tools such as those listed above.

The starting device 100 can include a hub 18, a rope pulley 16, a rope 12, a starter housing 10 and a torsion damper spring (not shown). The starting device 100 can be constructed so that the rope is coiled on the rope pulley 16 and can be removed from the pulley by an operator thereby rotating the rope pulley 16. The rope 12 is coupled to the rope pulley at an anchored end (not shown). A pull handle 14 is coupled at an opposite distal end from the anchored end of the rope 12. The rope 12 can be constructed of a natural or synthetic material. In at least one embodiment, the rope 12 is a braided rope 12 having multiple strands formed into a single rope.

The operator can grip the rope 12 using the pull handle 14. As the rope 12 is unwound from the rope pulley 16, the rope pulley 16 rotates about an axis. A torsion damper spring (not shown) can interconnect the rope pulley 16 with a hub 18. As illustrated, the hub 18 can have a one-way rotative mechanism that allows the hub 18 to transfer a starting force to the internal combustion engine. The hub 18 can be configured to interconnect with a clutch or one or more intermediary mechanisms which can transfer the starting force to internal combustion engine causing rotation of the crankshaft.

The hub 18 can be configured so that the hub 18 transfers the starting force to the internal combustion engine only in a single direction of rotation. As illustrated, the hub 18 can include hub teeth 24 which engage with and disengage from a pawl 22 of the internal engine. While the pawl 22 is illustrated, the pawl 22 is not a part of the starter device 100, but rather part of the internal combustion engine or an intermediary mechanism between the starter device 100 and the internal combustion engine. Additionally, the hub 18 can be configured so that when the hub 18 rotates in one direction, the hub 18 engages with the internal combustion engine or intermediary mechanism in one direction, but does not engage with the internal combustion engine or intermediary mechanism in another direction. In at least one embodiment, as illustrated, the intermediary mechanism can include at least a clutch having the pawl for engaging with the hub teeth 24. While only a single pawl 22 is illustrated, in other embodiments more than one pawl can be implemented. For example, the total number or pawls 22 and hub teeth 24 can be the same. As illustrated there are four hub teeth 24 and likewise there are four pawls 22. In yet other embodiments, the number of hub teeth and pawls can differ in number. For example, there can be fewer pawls than hub teeth 24.

While the illustrated example of the hub 18 includes teeth 24 for engagement with pawls 22, other embodiments can include implementation of other types of hubs that allow for transfer of rotational force in a single direction and can be returned to a home position after being rotated. Such a configuration can allow the hub 18 to return to a home position, the position where it was prior to being rotated, once the starter has started the engine. Additionally, a fastener 30 can be provided to hold the hub 18 and rope pulley 16 in place.

Figure 2:
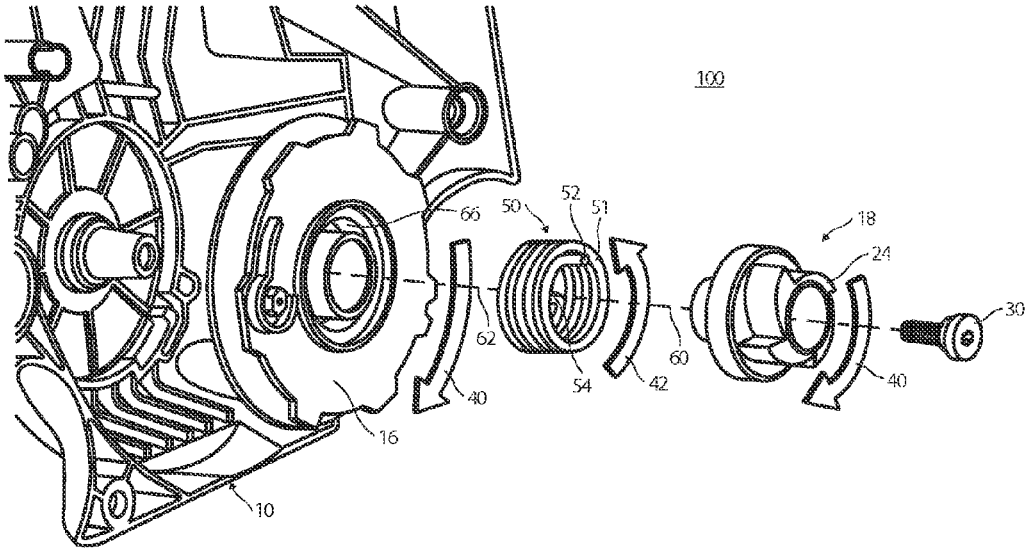
FIG. 2 illustrates an assembly view of an exemplary starting device including a hub, a rope pulley, and a torsion damper spring.

FIG. 2 illustrates an assembly view of an exemplary starting device. The rope pulley 16 can be configured to rotate with respect to the housing 10. The rope pulley 16 can be interconnected with the hub 18 by a torsion damper spring 50. The torsion damper spring 50 can be coupled at a first end 52 to the hub 18 and a second end 54 to the rope pulley 16. The first end 52 can be a straight end for stab engagement with the hub 18. Further examples of the coupling of the first end 52 with the hub 18 are provided below. Additionally, other configurations of coupling the first end 52 to the hub 18 are considered within the scope of this disclosure. The coupling of the second end 54 to the rope pulley 16 can be arranged in a similar fashion to the first end 52. The hub 18, torsion damper spring 50, and rope pulley 16 can be affixed to the starter housing 10 by a releasable fastener 30. As illustrated, the releasable fastener 30 can be a screw for holding the components of the starter device 100 in place in relation to the starter housing 10. In other embodiments, the releasable fastener 30 can be replaced by other types of fasteners to permanently affix the assembly together.

As illustrated, the hub 18 can be configured to drivingly engage an internal combustion engine when the hub 18 is rotated in a first direction 40. The torsion damper spring 50 can be coiled from the first end 52 toward the rope pulley 16 in a second direction 42 opposite to the first direction 40. When the rope is pulled, the rope pulley 16 can rotate in the first direction 40 causing the torsion damper spring 50 to responsively urge the hub 18 to rotate in the first direction 40 and drivingly engage the internal combustion engine. When the torsion damper spring 50 is coiled as described above, the coils of the torsion damper spring 50 do not rub against one another as the torsion damper spring 50 expands from a first diameter to a second diameter when the rotative force is transferred from the rope pulley 16 to the hub 18.

The rope pulley 16 can have an annular recess 66 formed therein and the hub 18 can have another annular recess formed therein. When the rope pulley 16 and hub 18 are held in place against one another, the two recesses can form a common annular recess. Examples of the recesses are presented below.

Figure 3:
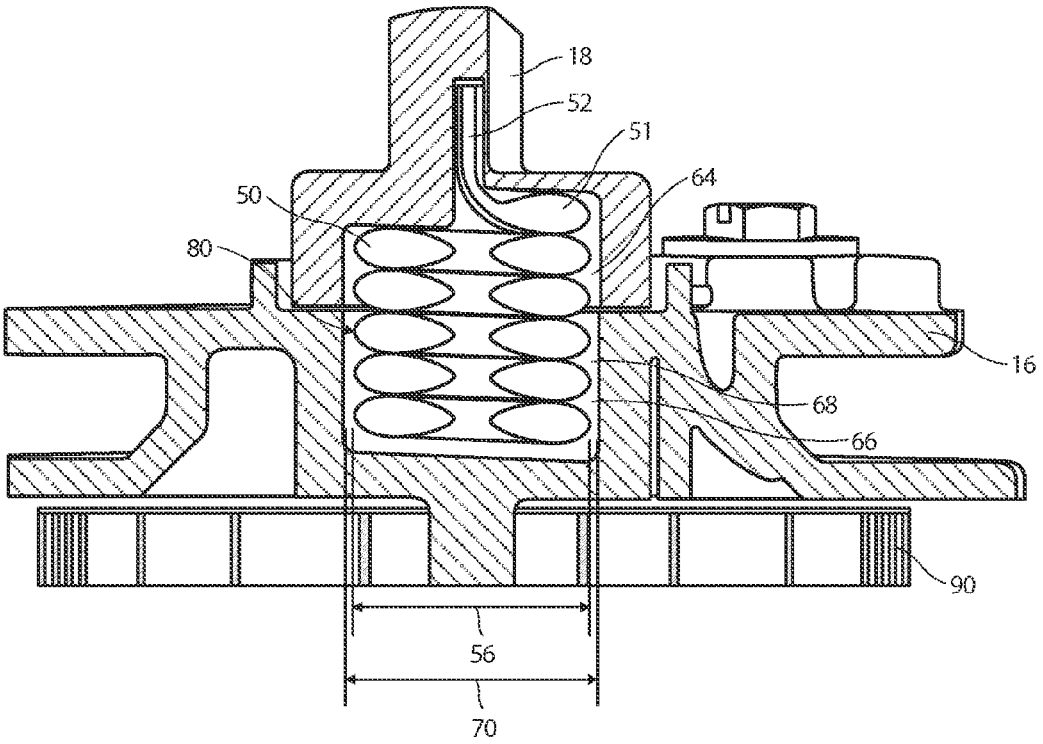
FIG. 3 illustrates a cross-sectional view of an assembled hub, rope pulley, and torsion damper spring in a relaxed state.

FIG. 3 illustrates an assembled cross-sectional view of the hub 18, rope pulley 16, and a torsion damper spring 50 in a relaxed state 80. The rope pulley can have an annular recess 66 formed therein for receiving a portion of the torsion damper spring 50. Likewise the hub 18 can have an annular recess 64 formed therein for receiving another portion of the torsion damper spring 50. As illustrated, the two recesses 64, 66 can form a common annular recess 68 for receiving therein coils 51 of the torsion damper spring 50. The annular recess 64, 66 can be formed about respective rotational axes 60, 62 as illustrated in FIG. 2. The location of the annular recesses 64, 66 about the rotational axes allows for the fastener to be placed along the rotational axes and provide for a transfer of force from the rope pulley 16 to the hub 18 by the torsion damper spring 50. As illustrated, the first end 52 of the torsion damper spring 50 is shown in an installed configuration in the hub 18.

Additionally, as illustrated, a recoil spring 90 can be coupled to the rope pulley 16. The recoil spring 90 can be utilized to store force as the rope pulley 16 rotates during the starting operation. As the rope rotates the rope pulley 16, the recoil spring 90 stores energy as the recoil spring 90 is transformed from a first state to a second state. In the first state, the recoil spring 90 can be neutral and exerts little or no force upon the rope pulley 16. When the rope is unwound from the rope pulley 16, the recoil spring 90 can be in the second state and urge rotation of the rope pulley 16 in a direction opposite from the direction that rope is unwound from the rope pulley 16, thereby urging the rope to retract upon the rope pulley 16, when the operator lets go of the pull handle.

In the relaxed state 80, the torsion damper spring 50 can have a first diameter 56, and the common annular recess 68 can have an outer diameter 70. The first diameter 56 of the torsion damper spring 50 can be smaller than the outer diameter 70 of the common annular recess. The outer diameter 70 can be sized based upon the second diameter, which can be larger than the first diameter 56, of the torsion damper spring 50 in a loaded state as explained in relation to FIG. 4.

Figure 4:
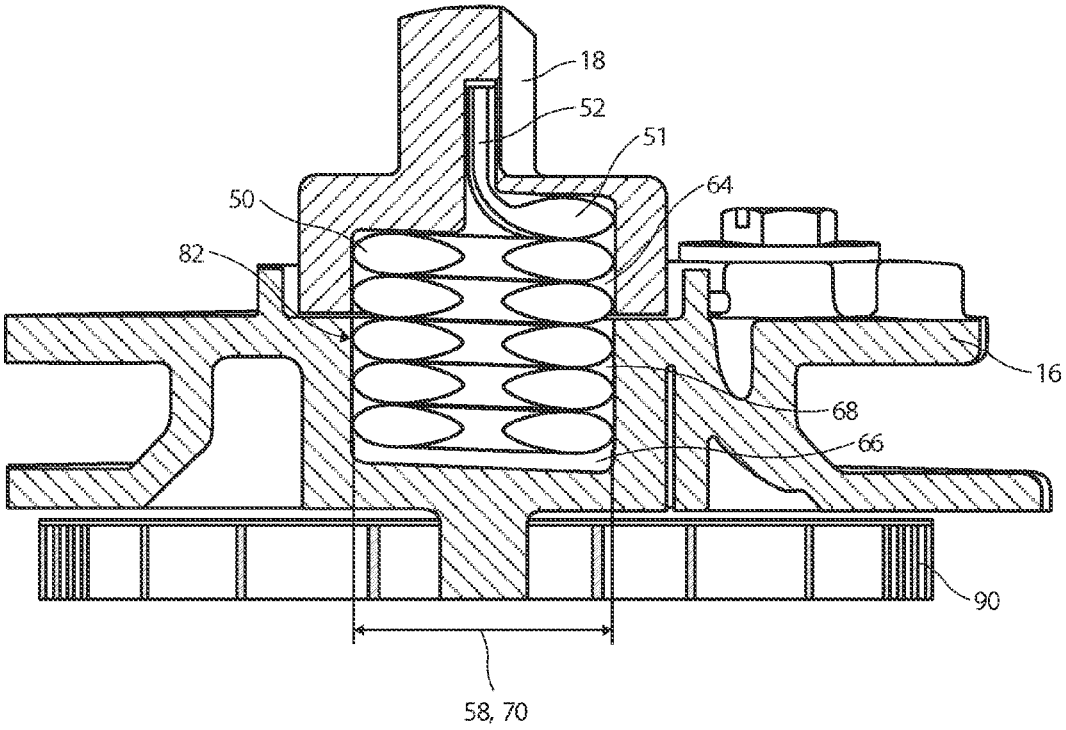
FIG. 4 illustrates a cross-sectional view of the assembled hub, rope pulley, and a torsion damper spring in a loaded state.

FIG. 4 illustrates an assembled hub, rope pulley similar to FIG. 3 wherein the torsion damper spring is in a loaded state 82 as compared with the relaxed state 80 of torsion damper spring 50 of FIG. 3. As illustrated, the torsion damper spring 50 can have a second diameter 58. The first diameter 56 of the torsion damper spring 50 in the relaxed state 80 can be smaller than second diameter 58 of the torsion damper spring 50 in the loaded state 82. As illustrated, the common annular recess 68 can have an outer diameter 70 that is substantially similar to the second diameter 58 of the torsion damper spring 50. In the illustrated example, the torsion damper spring 50 in the loaded state 82 can abut the outer diameter 70 of the common annular recess 68. In at least one embodiment, a majority of the coils 51 of the torsion damper spring 50 can abut the outer diameter 70 of the common annular recess 68 in the loaded state 82. The common annular recess 68 can prevent the diameter of the torsion damper spring 50 from exceeding a predetermined amount. For example, the torsion damper spring 50 can be designed to have a second diameter 58 in a loaded state to avoid possible deformation of the torsion damper spring 50. The common annular recess 68 can be sized so that it has an outer diameter 70 that is slightly smaller than second diameter 58. This can allow the torsion damper spring 50 to have an extended life. In at least one embodiment, the outer diameter 70 of the common annular recess 68 can be substantially the same as the second diameter 58 of the torsion damper spring 50.

Additionally, the configuration of the torsion damper spring 50 as described herein can further provide starting assistance during the compression stroke. When the rope is wound on the pulley 16, the torsion damper spring 50 is in the relaxed state 80. As the rope is unwound from the pulley 16 and the engine enters the compression stroke, the torsion damper spring 50 begins changing from the relaxed state to the loaded state. During the initial stages of the compression stroke the torsion damper spring 50 begins to store energy as well. As the engine nears a peak resistance to rotation in the compression stroke, the torsion damper spring 50 can be configured to release the stored energy to assist the operator in rotating the engine through the remainder of the compression stroke. When the torsion damper spring 50 is configured as described above, the starting of the engine is made easier to the operator. By storing the energy during the initial stages of the compression stroke for later release, the torsion damper spring 50 reduces the felt high resistance normally experienced at the peak resistance to rotation of the engine during the compression stroke. This reduces the effort of the operator during the peak resistance period. Furthermore, as the torsion damper spring 50 provides for a smoother starting as the overall felt resistance of the engine at the handle 14 is reduced.

Figure 5A:
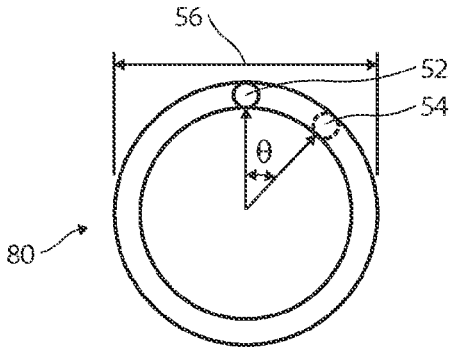
FIGS. 5A-D illustrate top plan views and side elevation views of an exemplary torsion damper spring in a relaxed state and a loaded state.
Figure 5B:
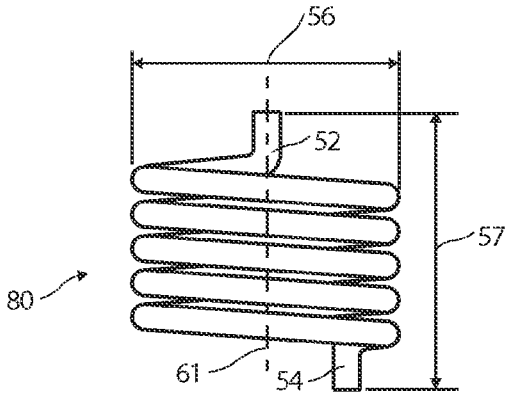
Figure 5C:
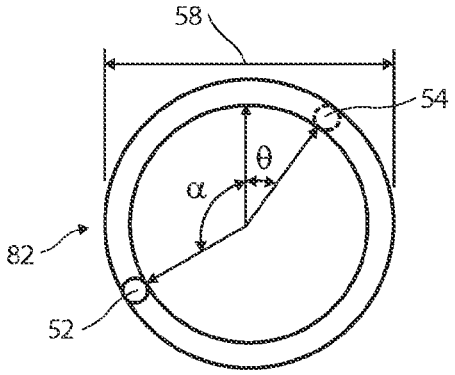
Figure 5D:
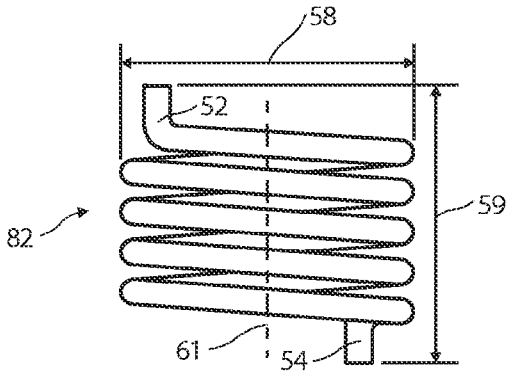

The torsion damper spring 50 is further illustrated in FIGS. 5A-D, which show top plan views and side elevation views of an exemplary torsion damper spring in a relaxed state and a loaded state. The torsion damper spring 50 can elastically deform between the relaxed state 80 and the loaded state 82. FIG. 5A illustrates a top plan view of a torsion damper spring 50 in a relaxed state 80. FIG. 5B illustrates an elevational view of the torsion damper spring 50 in the relaxed state 80. FIG. 5C illustrates a top plan view of the torsion damper spring 50 in a loaded state 80. FIG. 5D illustrates an elevational view of the torsion damper spring 50 in the loaded state 82.

In FIG. 5A, the torsion damper spring 50 can have a first diameter 56 and the first end 52 of the torsion damper spring 50 located at offset angular rotation (A) from the second end 54. The difference in angular position of the first end 52 as compared to the second end 54 is based upon the total number of turns of the torsion damper spring 50. For example, the total number of turns of the torsion damper spring 50 has approximately 5 coils 51. In another example, the total number of turns of the torsion damper spring 50 can have 5.1 coils 51. Other examples can have different number of coils 51 including 3, 4, 6, 7, and 8 coils.

In FIG. 5B, the rotational axis 61 of the torsion damper spring 50 is illustrated. As illustrated, the first end 52 can be parallel to the rotational axis 61 of the torsion damper spring 50.

When the torsion damper spring 50 is in a loaded state as illustrated in FIGS. 5C and D, the torsion damper spring 50 can have a second diameter 58. As illustrated the first diameter of FIGS. 5A and B are smaller than the second diameter 58. Additionally, as illustrated, in the loaded state 82 the first end 52 can have a relative angular rotation (a) compared to the relaxed state 80. As illustrated in FIGS. 5A-D, the torsion damper spring 50 can elastically deforms between the relaxed state 80 and the loaded state 82. As the torsion damper spring 50 deforms, the torsion damper spring 50 accommodates at relative angular rotation (a) between the first end 52 and the second end 54 between the relaxed stated and loaded state 82. The relative angular rotation (a) can be ninety degrees. In another embodiment, the relative angular rotation (a) can be between sixty degrees and ninety degrees. In yet another embodiment, the relative angular rotation (a) can be at least one hundred degrees. In another example, the relative angular rotation (a) can be at least two hundred-seventy degrees. In other embodiments, the relative angular rotation (a) can be between one hundred and two hundred-seventy degrees. In still other embodiments, the relative angular rotation (a) can be between sixty and three hundred-sixty degrees. In another embodiment, the torsion damper spring 50 can elastically deform between the re relaxed state 80 and the loaded state 82 and the first end 52 and the second end 54 of the torsion damper spring can angularly rotate approximately one hundred degrees relative one to the other between the relaxed state 80 and the loaded state 82. Additionally, the other angles as described above can equally apply in this case as well.

When the torsion damper spring 50 is in the relaxed state 80, the coils 51 of the spring either abut one another or almost abut one another in the direction of the rotational axis 61 of the torsion damper spring 50. In the loaded state 82, the coils 51 of the torsion damper spring 50 are further spaced apart in the direction of the rotational axis 61 of the torsion damper spring 50.

Additionally, the length 57 of the torsion damper spring 50 in the relaxed state 80 can be substantially the same as the length 59 of the torsion damper spring 50 in the loaded state 82. The length 57 of the torsion damper spring 50 in the relaxed state 80 can also be slightly larger than the length 59 of the torsion damper spring 50 in the loaded state 82. The first end 52 and the second end 54 as described are parallel to rotational axis 61 of the torsion damper spring 50. The length of the first end 52 and second end 54 can be sized so as to allow the spring to remain coupled to the hub 18 and rope pulley 16, respectively. The length of the first end 52 and the second end 54 allow for the torsion damper spring 50 to be maintained in the installed configuration despite the change in diameter and/or of the torsion damper spring 50.

In sizing the torsion damper spring 50, the relative angular rotation (a) can be chosen based on the application of the starter device 100 or the relative angular rotation (a) can result from selecting other factors of the torsion damper spring 50. For example, the spring rate of the torsion damper spring can be selected. In one example, the torsion damper spring 50 can have a spring rate of at least 0.15 inch-pounds per degree of rotation. In another example, the torsion damper spring 50 can have a spring rate of 0.181 inch-pounds per degree of rotation. In yet another example, the torsion damper spring 50 can have a spring rate of between at least 0.1 inch-pounds per degree of rotation and approximately 0.25 inch-pounds per degree of rotation.

Figure 6:
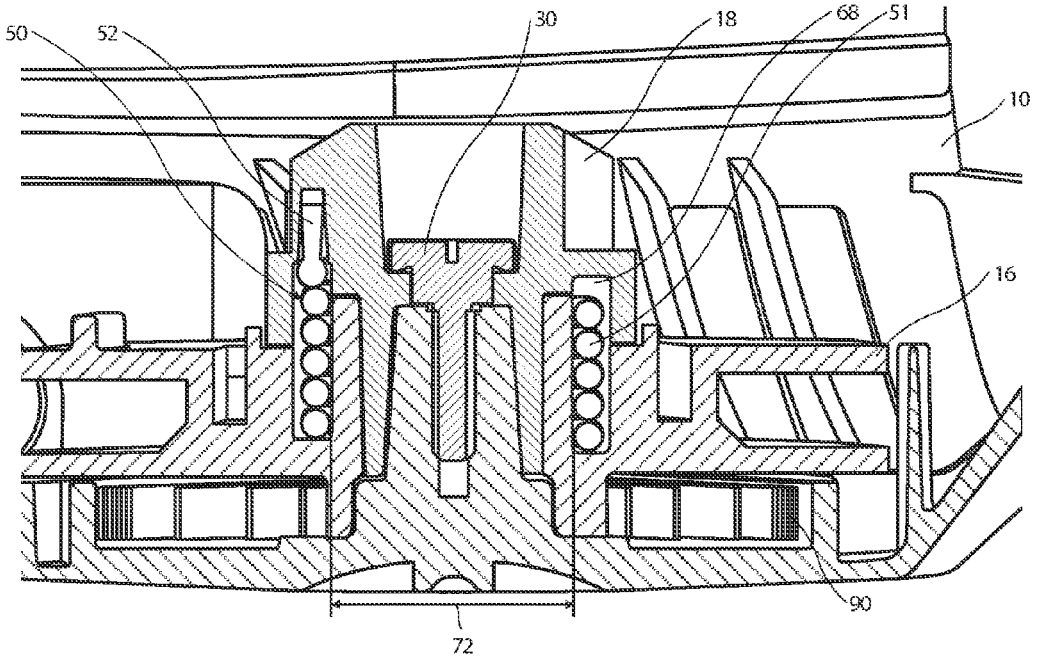
FIG. 6 illustrates a cross-sectional view of the starting device wherein the torsion damper spring is in a relaxed state.

FIG. 6 illustrates a cross-sectional view of the starting device 100 wherein the torsion damper spring 50 is in a relaxed state 80. As illustrated, the first end 52 of the torsion damper spring 50 can be coupled with the hub 18. A fastener 30 can hold the hub 18 against the rope pulley 16 whereby a common annular recess 68 is formed. The common annular recess 68 can have an inner diameter 72. In at least one embodiment, the inner diameter 72 of the common annular recess 68 can be slightly smaller than the first diameter 56 of the torsion damper spring 50. As illustrated the coils 51 of the torsion damper spring 50 are positioned in the common annular recess 68 about the inner diameter 72 of the common annular recess 68 in the relaxed state 80.

Figure 7:
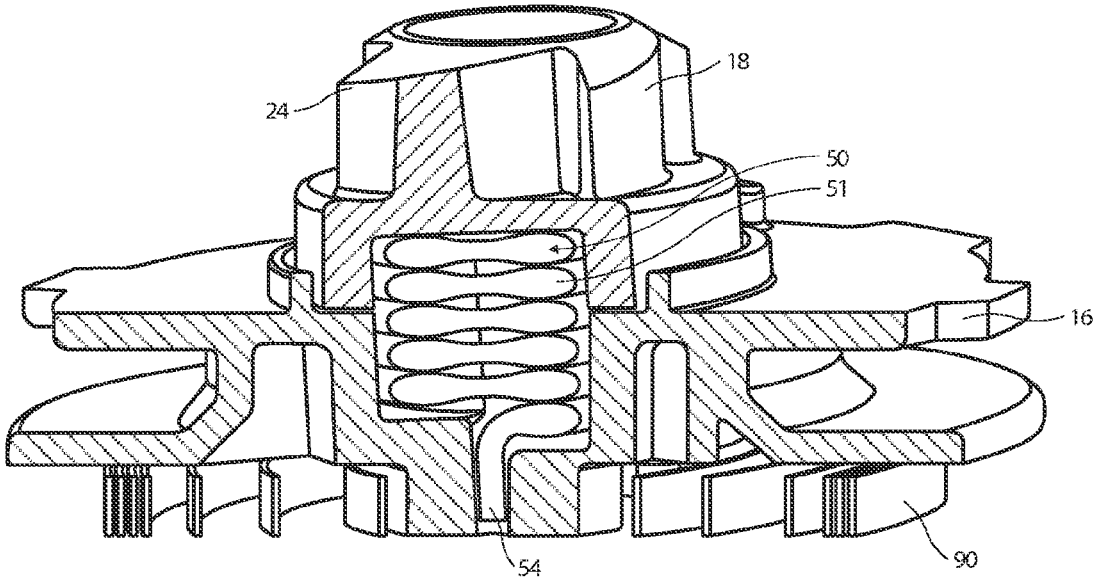
FIG. 7 illustrates a cross-sectional perspective view of the hub, rope pulley and torsion damper spring.

FIG. 7 illustrates a cross-sectional perspective view of the hub 18, rope pulley 16 and torsion damper spring 50. The hub 18 includes teeth 24. The shape of the teeth is illustrated to show how the teeth 24 can be shaped so as to provide a one-way rotative force to the internal combustion engine. Additionally, the second end 54 is coupled to the rope pulley 16. The second end 54 is shaped so that it is a stab in connection with the rope pulley 16. In other embodiments, the second end 54 can be coupled to the rope pulley for example by bonding, additional fasteners. In other embodiments, the second end 54 can be parallel to the rope pulley 16.

What is claimed is:

1. A rope-pull starting device for an internal combustion engine, the starting device comprising:

a hub configured to drivingly engage an internal combustion engine when the hub is rotated in a first direction;

a rope pulley interconnected with the hub by a torsion damper spring;

a rope coiled, from an anchored end thereof, about the rope pulley in the first direction; and the torsion damper spring coupled at a first end to the hub and at a second end to the rope pulley, wherein the torsion damper spring is coiled from the first end connected to the hub, toward the rope pulley, in a second direction opposite to the first direction, and whereby the rope pulley is rotated in the first direction when the rope is pulled and unwound therefrom and the torsion damper spring responsively urges the hub to rotate in the first direction and drivingly engage the internal combustion engine;

the rope pulley and the hub each have an annular recess formed therein about respective rotational axes thereof and wherein the two annular recesses are substantially aligned, one with the other, thereby forming a common annular recess for receiving therein coils of the torsion damper spring, wherein the torsion damper spring has a first diameter in a relaxed state and a second diameter in a loaded state, the first diameter being smaller than the second diameter and wherein the common annular recess has an outer diameter that is substantially the same as the second diameter of the torsion damper spring and prevents the diameter of the torsion damper spring from exceeding a predetermined amount, wherein the torsion damper spring elastically deforms between the relaxed state and loaded state and correspondingly accommodates between sixty degrees and three hundred sixty degrees of relative angular rotation (alpha) between the first end and second end of the torsion damper spring between the relaxed state and loaded state.

2. The starting device of claim 1, wherein the torsion damper spring elastically deforms between the relaxed state and loaded state and correspondingly accommodates at least one hundred degrees of relative angular rotation between the first end and second end of the torsion damper spring between the relaxed state and loaded state.

3. The starting device of claim 1, wherein the torsion damper spring elastically deforms between the relaxed state and loaded state and the first end and second end of the torsion damper spring angularly rotate one hundred degrees relative one to the other between the relaxed state and loaded state.

4. The starting device of claim 1, wherein the torsion damper spring elastically deforms between the relaxed state and loaded state and correspondingly accommodates between one hundred degrees and two hundred seventy degrees of relative angular rotation (alpha) between the first end and second end of the torsion damper spring between the relaxed state and loaded state.

5. The starting device of claim 1, wherein the torsion damper spring has between 3 and 8 coils.

6. The starting device of claim 1, wherein the torsion damper spring has 5.1 coils.

7. The starting device of claim 1, wherein the torsion damper spring has a spring rate of between at least 0.1 inch-pounds per degree of rotation and 0.25 inch-pounds per degree of rotation.

8. The starting device of claim 7, wherein the torsion damper spring has a spring rate of at least 0.15 inch-pounds per degree of rotation.

9. The starting device of claim 7, wherein the torsion damper spring has a spring rate of 0.181 inch-pounds per degree of rotation.

10. The starting device of claim 1, wherein the rope is coupled at the anchored end to the rope pulley and is coupled at an opposite distal end to a pull handle.

11. The starting device of claim 10, wherein the rope is constructed from one of a synthetic material and a natural material.

12. The starting device of claim 1, further comprising a recoil spring coupled to the rope pulley, wherein the recoil spring applies a return motive force upon the rope pulley when the rope is in an extended configuration.

13. The starting device of claim 1, wherein the rope pulley and the hub each have an annular recess formed therein about respective rotational axes thereof and wherein the two annular recesses are substantially aligned, one with the other, thereby forming a common annular recess for receiving therein coils of the torsion damper spring, wherein the torsion damper spring has a first diameter in a relaxed state and a second diameter in a loaded state, the first diameter being smaller than the second diameter and wherein the common annular recess has an outer diameter that is substantially the same as the second diameter of the torsion damper spring and prevents the diameter of the torsion damper spring from exceeding a predetermined amount.

14. The starting device of claim 13, wherein the torsion damper spring abuts the outer diameter of the common annular recess in a loaded state.

15. The starting device of claim 14, wherein a majority of the coils of the torsion damper spring abut the outer diameter of the common annular recess in the loaded state.

16. The starting device of claim 13, wherein the common annular recess has an inner diameter slightly smaller than the first diameter of the torsion damper spring.

17. The starting device of claim 16, wherein coils of the torsion damper spring are positioned in the common annular recess about the inner diameter of the common annular recess in the relaxed state.

18. A hand-held power driven tool comprising:

a starting device comprising:

a hub configured to drivingly engage an internal combustion engine when the hub is rotated in a first direction;

a rope pulley interconnected with the hub by a torsion damper spring;

a rope coiled, from an anchored end thereof, about the rope pulley in the first direction; and the torsion damper spring coupled at a first end to the hub and at a second end to the rope pulley, wherein the torsion damper spring is coiled from the first end connected to the hub, toward the rope pulley, in a second direction opposite to the first direction, and whereby the rope pulley is rotated in the first direction when the rope is pulled and unwound therefrom and the torsion damper spring responsively urges the hub to rotate in the first direction and drivingly engage the internal combustion engine, the rope pulley and the hub each have an annular recess formed therein about respective rotational axes thereof and wherein the two annular recesses are substantially aligned, one with the other, thereby forming a common annular recess for receiving therein coils of the torsion damper spring, wherein the torsion damper spring has a first diameter in a relaxed state and a second diameter in a loaded state, the first diameter being smaller than the second diameter and wherein the common annular recess has an outer diameter that is substantially the same as the second diameter of the torsion damper spring and prevents the diameter of the torsion damper spring from exceeding a predetermined amount, wherein the torsion damper spring elastically deforms between the relaxed state and loaded state and correspondingly accommodates between sixty degrees and three hundred sixty degrees of relative angular rotation (alpha) between the first end and second end of the torsion damper spring between the relaxed state and loaded state.

19. The hand-held power driven tool of claim 18 is one of a chainsaw, a line trimmer, a leaf blower and a snow blower.

20. A chainsaw comprising a starting device comprising:

a starting device comprising:

a hub configured to drivingly engage an internal combustion engine when the hub is rotated in a first direction;

a rope pulley interconnected with the hub by a torsion damper spring;

a rope coiled, from an anchored end thereof, about the rope pulley in the first direction; and the torsion damper spring coupled at a first end to the hub and at a second end to the rope pulley, wherein the torsion damper spring is coiled from the first end connected to the hub, toward the rope pulley, in a second direction opposite to the first direction, and whereby the rope pulley is rotated in the first direction when the rope is pulled and unwound therefrom and the torsion damper spring responsively urges the hub to rotate in the first direction and drivingly engage the internal combustion engine, the rope pulley and the hub each have an annular recess formed therein about respective rotational axes thereof and wherein the two annular recesses are substantially aligned, one with the other, thereby forming a common annular recess for receiving therein coils of the torsion damper spring, wherein the torsion damper spring has a first diameter in a relaxed state and a second diameter in a loaded state, the first diameter being smaller than the second diameter and wherein the common annular recess has an outer diameter that is substantially the same as the second diameter of the torsion damper spring and prevents prevent the diameter of the torsion damper spring from exceeding a predetermined amount, wherein the torsion damper spring elastically deforms between the relaxed state and loaded state and correspondingly accommodates between sixty degrees and three hundred sixty degrees of relative angular rotation (alpha) between the first end and second end of the torsion damper spring between the relaxed state and loaded state.

* * * * *